US008840384B2

(12) United States Patent
Patel et al.

(10) Patent No.: US 8,840,384 B2
(45) **Date of Patent: *Sep. 23, 2014**

(54) SCROLL COMPRESSOR CAPACITY MODULATION WITH SOLENOID MOUNTED OUTSIDE A COMPRESSOR SHELL

(75) Inventors: Tapesh P. Patel, Hotsprings, AR (US); Gene Fields, Arkadelphia, AR (US); Joe T. Hill, Arkadelphia, AR (US); Tracy L. Milliff, Arkadelphia, AR (US); Harshal Upadhye, Charlotte, NC (US); Behzad Parastar, Kolding (DK); Ole Holst Christensen, Kolding (DK)

(73) Assignee: Danfoss Scroll Technologies, LLC, Arkadelphia, AR (US)

( * ) Notice: Subject to any disclaimer, the term of this patent is extended or adjusted under 35 U.S.C. 154(b) by 634 days.

This patent is subject to a terminal disclaimer.

(21) Appl. No.: 12/555,037

(22) Filed: Sep. 8, 2009

(65) Prior Publication Data

US 2011/0058972 A1 Mar. 10, 2011

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 28/26*** | (2006.01) |
| ***F04C 18/02*** | (2006.01) |
| ***F04C 23/00*** | (2006.01) |

(52) U.S. Cl.

CPC ..... *F04C 23/008* (2013.01); *F04C 2270/58* (2013.01); *F04C 28/26* (2013.01); *F04C 18/0215* (2013.01); *F04C 18/0261* (2013.01)

USPC ..... 418/55.5; 418/15; 418/55.1; 418/57; 418/270; 417/310; 417/410.5

(58) Field of Classification Search

USPC ..... 418/14, 15, 55.1–55.6, 57, 270; 417/310, 410.5, 440, 299

See application file for complete search history.

(56) References Cited

U.S. PATENT DOCUMENTS

| | | | | |
|---|---|---|---|---|
| 4,496,296 | A * | 1/1985 | Arai et al. | 418/55.5 |
| 5,336,058 | A * | 8/1994 | Yokoyama | 418/55.1 |
| 5,551,846 | A * | 9/1996 | Taylor et al. | 417/310 |
| 5,996,364 | A | 12/1999 | Lifson et al. | |
| 6,139,287 | A * | 10/2000 | Kuroiwa et al. | 417/310 |
| 6,478,550 | B2 * | 11/2002 | Matsuba et al. | 417/310 |
| 8,308,448 | B2 * | 11/2012 | Fields et al. | 417/310 |

FOREIGN PATENT DOCUMENTS

| | | | | |
|---|---|---|---|---|
| JP | 62023589 | A * | 1/1987 | 418/14 |

OTHER PUBLICATIONS

JP62-023589 A,Sone et al., Scroll Compressor, Jan. 1987_English Tranlsation.*

* cited by examiner

*Primary Examiner* — Theresa Trieu

(74) *Attorney, Agent, or Firm* — Carlson, Gaskey & Olds, PC

(57) ABSTRACT

At least one bypass opening is formed in a base of a scroll member, and communicates with at least one compression chamber. The bypass opening communicates with a passage leading to a suction pressure chamber within a compressor shell. A valve includes an element electrically powered to move between a first position at which it blocks flow of refrigerant from the bypass port to the passage leading to the suction pressure chamber, and a second position at which it allows flow of refrigerant between the bypass port and the passage leading to the suction pressure chamber. A portion of the valve, which is electrically powered, is mounted outside of the compressor shell.

12 Claims, 1 Drawing Sheet

SCROLL COMPRESSOR CAPACITY MODULATION WITH SOLENOID MOUNTED OUTSIDE A COMPRESSOR SHELL

BACKGROUND OF THE INVENTION

A scroll compressor is provided with a capacity modulation control, including a solenoid valve which can be moved to selectively move the compressor between a full capacity and a reduced capacity position, and wherein the solenoid valve is mounted outside of a compressor shell.

Scroll compressors are becoming widely utilized in refrigerant compression applications. In a scroll compressor, a pair of generally spiral wraps interfit to define compression chambers. One of the wraps is caused to orbit relative to the other, and as the two move, the size of the compression chamber is reduced, thereby compressing an entrapped refrigerant.

Under certain conditions, the capacity, or amount of refrigerant compressed by the compressor, may be desirably reduced. As an example, if the compressor is incorporated into an air conditioning system, and the cooling load is low, then it is more energy efficient to compress less refrigerant.

Various ways are known for reducing the capacity, including moving a valve to selectively open a passage to allow refrigerant to move from a partially compressed location back to a suction. However, providing power to these valves has been somewhat challenging.

In particular, when electric valves such as solenoid valves have been utilized to provide capacity control within a scroll compressor, they have been mounted within a hermetically sealed compressor shell. Thus, the valves are exposed to the refrigerant circulating within the shell. The terminals that supply electric power to the valves must then have a hermetically sealed connection. In addition, since the valve is within the shell, it is somewhat difficult to cool the valve, or replace the valve.

It has been proposed to mount such a valve entire outside of a shell. However, this requires communicating flow passages, which are outside of the shell also, and thus leads to some plumbing challenges.

SUMMARY OF THE INVENTION

At least one bypass opening is formed in a base of a scroll member, and communicates with at least one compression chamber. The bypass opening communicates with a passage leading to a suction pressure chamber within a compressor shell. A valve includes an element electrically powered to move between a first position at which it blocks flow of refrigerant from the bypass port to the passage leading to the suction pressure chamber, and a second position at which it allows flow of refrigerant between the bypass port and the passage leading to the suction pressure chamber. A portion of the valve, which is electrically powered, is mounted outside of the compressor shell.

These and other features of the present invention can be best understood from the following specification and drawings, the following of which is a brief description.

DETAILED DESCRIPTION OF THE PREFERRED EMBODIMENT

Figure 1:
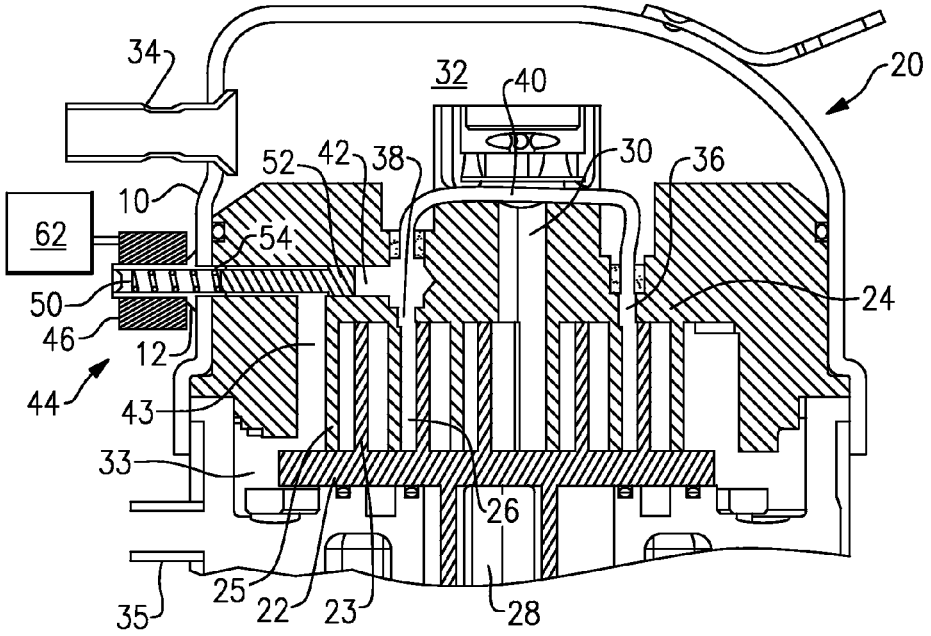
FIG. 1 shows a scroll compressor in a full capacity position.

A scroll compressor 20 is illustrated in FIG. 1. As known, an orbiting scroll member 22 includes a generally spiral wrap 23. A non-orbiting scroll member 24 includes its own generally spiral wrap 25. The wraps 23 and 25 interfit to define compression chambers 26. A shaft 28 drives the orbiting scroll member 22 to orbit relative to the non-orbiting scroll member 24. As the orbiting occurs, a refrigerant entrapped within the chambers 26 is compressed toward a discharge port 30. Discharge port 30 communicates refrigerant into a discharge pressure chamber 32, and to a discharge tube A suction pressure chamber 33 receives refrigerant to be compressed, such as through a suction tube 35.

Bypass passages 36 and 38 each communicate with one of the compression chambers 26. These passages 36 and 38 also communicate through tube 40 with a passage 42 and 43 leading back to the suction pressure chamber 33. Although not specifically shown in FIG. 1, tube 40 is off-center from a centerline of the discharge port 30, and driveshaft 28.

As shown, a solenoid valve 44 blocks flow of refrigerant in the passage 42 from reaching the passage 43. The solenoid valve 44 includes a moving pin 52 movable within a housing 54. A spring 50 biases the moving pin 52 to position shown in FIG. 1 at which it blocks the flow of refrigerant.

As is clear, the solenoid 44 is mounted on the outer wall of the housing, and the moving pin is movable, at a location intermediate the suction pressure chamber 33 and the discharge pressure chamber 32. The solenoid 44 includes a solenoid motor 46. An enlarged neck 12 abuts an outer surface of a compressor shell 10 which houses the scroll members 22, 24, the driveshaft 28, the suction pressure chamber 33, and the discharge pressure chamber 32. As known, the shell 10 is hermetically sealed to enclose refrigerant during operation of the compressor. The mounting of the solenoid on the outer wall of the housing allows the electric connections 60 to be easily made. The neck 12 ensures a fluid-tight seal between the shell 10 and the housing 54.

When a reduced capacity is desired, a control 62 communicates with the solenoid motor 46, and pulls the moving pin 52 back into the housing 54 against the bias of the spring 50. Now, refrigerant in passage 42 communicates to passage 43, and the capacity provided by the compressor is reduced as shown in FIG. 2.

Figure 2:
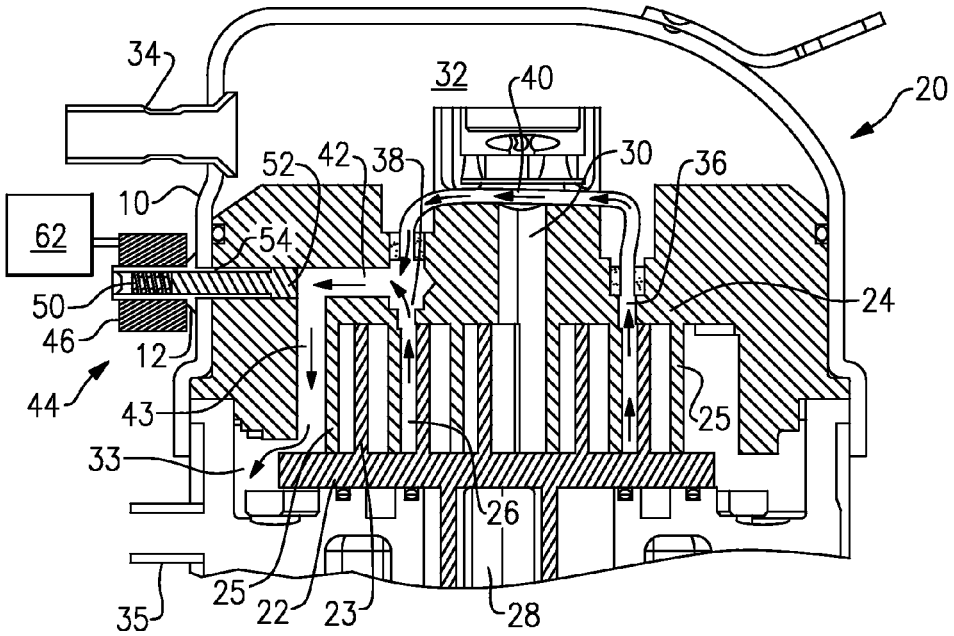
FIG. 2 shows the scroll compressor in a reduced capacity position.

While the solenoid is shown being biased to the FIG. 1 position, and drawn by magnetic force to the FIG. 2 position, this could be reversed.

With the inventive location of the solenoid valve 44 on the outer surface of the compressor shell 10, the solenoid valve can be simply welded to the shell 10, such as at the enlarged portion 12. This location for the solenoid valve will allow air cooling of the valve during operation, and will also facilitate replacement of the valve should it become damaged.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a compressor shell having first and second scroll members, said first scroll member having a base and a generally spiral wrap extending from its base;

said second scroll member having a base and a generally spiral wrap extending from its base, said generally spiral wraps of said first and second scroll members interfitting to define compression chambers;

a shaft for causing said second scroll member to orbit relative to said first scroll member;

at least one bypass port formed in said base of said first scroll member, and communicating with at least one of said compression chambers, and said at least one bypass port communicating with a passage leading to a suction pressure chamber within said compressor shell, and said passage being within said compressor shell;

a valve, including an element electrically powered to move between a first position at which it blocks flow of refrigerant from said bypass port to said passage leading to said suction pressure chamber, and a second position at which it allows flow of refrigerant between said bypass port, and said passage leading to said suction pressure chamber and a portion of said valve which is electrically powered being mounted outside of said compressor shell and on an outer surface of said compressor shell;

said compressor shell housing said suction pressure chamber, said first and second scroll members, said shaft, and a discharge pressure chamber which is downstream of said compression chambers; and said valve is mounted on said outer surface of said compressor shell, and said element moveable within said compressor shell at a location intermediate said suction and discharge pressure chambers.

2. The scroll compressor as set forth in claim 1, wherein there are a pair of said bypass ports each communicating with said passage leading to said suction pressure chamber.

3. The scroll compressor as set forth in claim 1, wherein said valve includes a radially outward enlarged neck which abuts an outer surface of said compressor shell.

4. The scroll compressor as set forth in claim 1, wherein said valve is a solenoid valve.

5. The scroll compressor as set forth in claim 1, wherein said element is movable within said compressor shell.

6. The scroll compressor as set forth in claim 5, wherein said element includes a portion extending outwardly of said compressor shell and into a housing of said valve.

7. The scroll compressor as set forth in claim 6, wherein a spring normally biases said element to at least one of said first and second positions.

8. The scroll compressor as set forth in claim 7, wherein said spring normally biases said element to said first position.

9. The scroll compressor as set forth in claim 1, wherein said shell is hermetically sealed.

10. A scroll compressor comprising:

a compressor shell having first and second scroll members, said first scroll member having a base and a generally spiral wrap extending from its base;

said second scroll member having a base and a generally spiral wrap extending from its base, said generally spiral wraps of said first and second scroll members interfitting to define compression chambers;

a shaft for causing said second scroll member to orbit relative to said first scroll member;

at least one bypass port formed in said base of said first scroll member, and communicating with at least one of said compression chambers, and said at least one bypass port communicating with a passage leading to a suction pressure chamber within said compressor shell, and said passage being within said compressor shell;

a valve, including an element electrically powered to move between a first position at which it blocks flow of refrigerant from said bypass port to said passage leading to said suction pressure chamber, and a second position at which it allows flow of refrigerant between said bypass port, and said passage leading to said suction pressure chamber and a portion of said valve which is electrically powered being mounted outside of said compressor shell;

a pair of said bypass port each communicating with said passage leading to said suction pressure chamber; and a tube interconnecting said bypass ports.

11. A scroll compressor comprising:

a compressor shell having first and second scroll members, said first scroll member having a base and a generally spiral wrap extending from its base;

said second scroll member having a base and a generally spiral wrap extending from its base, said generally spiral wraps of said first and second scroll members interfitting to define compression chambers;

a shaft for causing said second scroll member to orbit relative to said first scroll member;

a pair of bypass ports formed in said base of said first scroll member, and communicating with said compression chambers, and said bypass ports communicating with a passage leading to a suction pressure chamber within said compressor shell;

a valve, including an element electrically powered to move between a first position at which it blocks flow of refrigerant from said bypass port to said passage leading to said suction pressure chamber, and a second position at which it allows flow of refrigerant between said bypass port, and said passage leading to said suction pressure chamber and a portion of said valve which is electrically powered being mounted outside of said compressor shell and on an outer surface of said compressor shell;

said element is movable within said compressor shell, said element includes a portion extending outwardly of said compressor shell and into a housing of said valve; and said compressor shell housing said suction pressure chamber, said first and second scroll members, said shaft, and a discharge pressure chamber which is downstream of said compression chambers; and said valve is mounted on said outer surface of said compressor shell, and said element is moveable within said compressor shell at a location intermediate said suction and discharge pressure chambers.

12. The scroll compressor as set forth in claim 11, wherein said shell is hermetically sealed.

* * * * *